US006827492B2

(12) United States Patent
Cook

(10) Patent No.: US 6,827,492 B2
(45) Date of Patent: Dec. 7, 2004

(54) ONE-WAY CONCEALED-VALVE VENTED STORAGE BAG

(76) Inventor: Leland B. Cook, 9810 NW. 12th Ave., Vancouver, WA (US) 98665

( * ) Notice: Subject to any disclaimer, the term of this patent is extended or adjusted under 35 U.S.C. 154(b) by 48 days.

(21) Appl. No.: 10/290,890

(22) Filed: Nov. 8, 2002

(65) Prior Publication Data

US 2003/0103694 A1 Jun. 5, 2003

Related U.S. Application Data

(60) Provisional application No. 60/337,108, filed on Dec. 5, 2001.

(51) Int. Cl.[7] ..... B65D 33/01
(52) U.S. Cl. ..... 383/103; 383/113
(58) Field of Search ..... 383/103, 100, 383/101, 109, 113

(56) References Cited

U.S. PATENT DOCUMENTS 4,122,993 A * 10/1978 Glas ..... 383/103
4,365,715 A * 12/1982 Egli ..... 206/524.8
5,209,264 A 5/1993 Koyanagi
5,281,027 A 1/1994 Thrall
5,540,500 A 7/1996 Tanaka
5,553,943 A 9/1996 Cook et al.
5,584,409 A * 12/1996 Chemberlen ..... 220/89.1
5,689,866 A 11/1997 Kasai et al.
6,056,439 A * 5/2000 Graham ..... 383/103
6,070,728 A * 6/2000 Overby et al. ..... 206/524.8

* cited by examiner

*Primary Examiner*—Jes F. Pascua
(74) *Attorney, Agent, or Firm*—Jon M. Dickinson, PC; Robert D. Varitz, PC

(57) ABSTRACT

A one-way outwardly gas and moisture vented, plural-layer bag for a product, such as a dry bulk product, in which bag a concealed valve is positioned near one side, and close to the originally open top, of the bag. Openings in the valve communicate with confronting openings in a gas and moisture impervious inner layer in the bag.

2 Claims, 2 Drawing Sheets

ONE-WAY CONCEALED-VALVE VENTED STORAGE BAG

This application claims benefit of the provisional Application No. 60/337,108. Filed Dec. 5, 2001.

BACKGROUND AND SUMMARY OF THE INVENTION

This invention relates to a storage bag for bulk, dry, powdered product, such as a powdered milk product. More particularly, it relates to a bag in this category which is specially prepared for the concealed-value exo-venting of bag-trapped gas and moisture that ends up residing inside the bag following product filling and sealing.

It is typical for such a bag to be constructed, as an illustration, from plural thin layers of material, including paper material, as well as at least one layer which is formed of a moisture- and gas-impervious plastic material (layer). The present invention proposes the incorporation, at a special location and region concealed within such a bag, of a uniquely organized and arranged valving structure which allows for the reliable exo-venting (one way only) of otherwise trapped moisture and gas.

With regard to a bagged bulk product such as dry milk, bag-retained excess moisture and gas can cause problems. Retained moisture can cause product degradation, and excess retained gas can create a bag ballooning effect which leads to bag-stack unstability in palletized loads of plural, stacked bags. It is thus very important to provide a mechanism for permitting the unidirectional, outward venting of as much otherwise retained moisture and gas as possible.

Preferably, the venting of a bag to allow for the escape of such trapped moisture and gas is accomplished in such a manner that venting capability will not be compromised (blocked) by the very act, and indeed the normally expected act, of stacking bags in a close side-by-side relationship and one on top of another. In other words, bag venting structure preferably must not be so located in a bag that overlying stacked bags which mutually sit upon one another, and next-adjacent side-by-side bags, can cause occluding of that important structure. Additionally, it is desirable that any one-way valve which is employed for exo-venting purposes be concealed by a region of a bag layer from the outside so that its reliable functionality is not unnecessarily compromised by exposure-related damage.

The present invention addresses these issues in a very practical and satisfactory manner, and in plural proposed embodiments, in each of which, an exo-valving structure is uniquely incorporated into the bag in a concealed manner to permit outward passage of gas and moisture through the moisture and vapor barrier layer in the bag, and at a location which essentially will not become blocked under ordinary and conventional bag-stacking and handling operations and conditions. The various important features and operating advantages of the present invention will become fully apparent as the description which now follows is read in conjunction with the accompanying drawings.

DETAILED DESCRIPTION OF THE INVENTION

Figure 1:
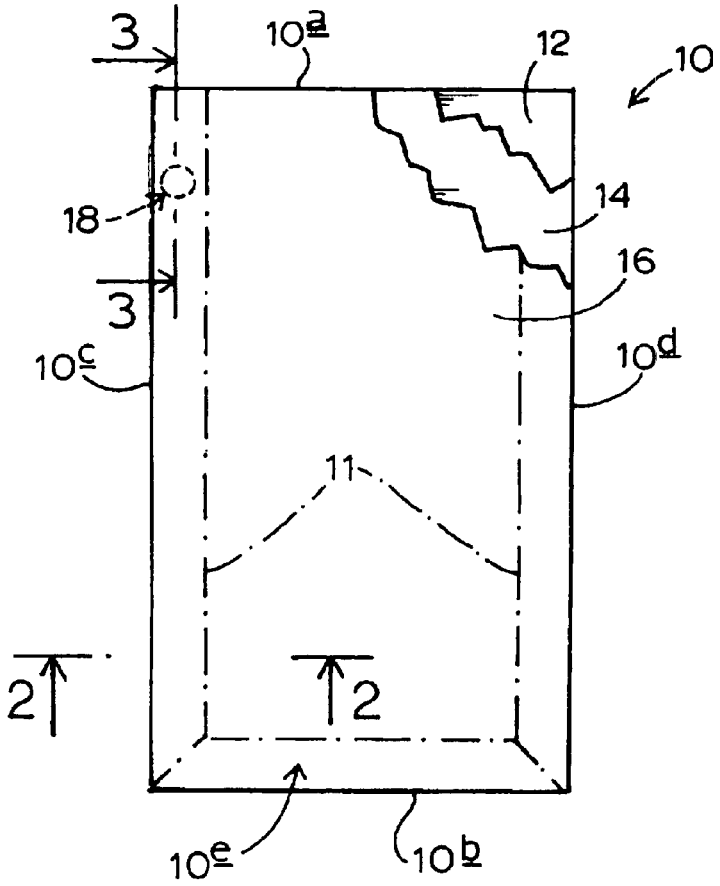
FIG. 1 is a simplified plan view of a yet unfilled, dry bulk product storage bag which is prepared for exo-venting of gas and moisture in accordance with the present invention.
Figure 2:
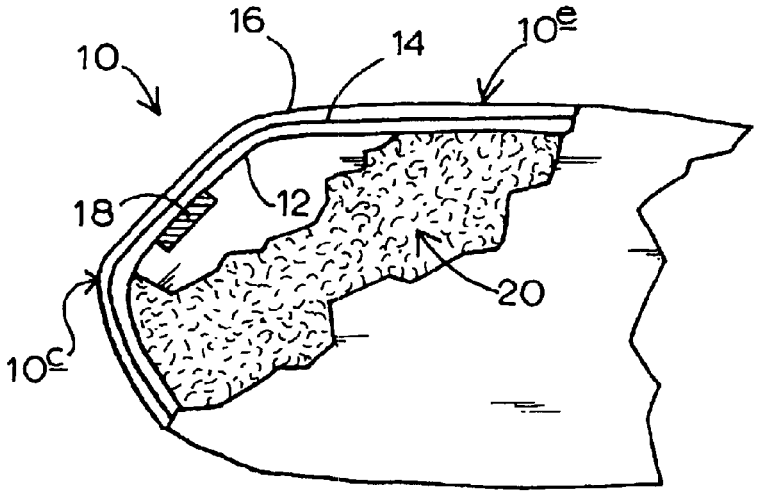
FIG. 2 is a much larger scale fragmentary view, taken generally from the point of view indicated at 2—2 in FIG. 1, illustrating the bag of FIG. 1 in a filled and sealed condition, and demonstrating how (outwardly concealed) valving structure positioned in accordance with this invention becomes deployed properly to furnish reliable venting of gas and moisture from the bag.
Figure 3:
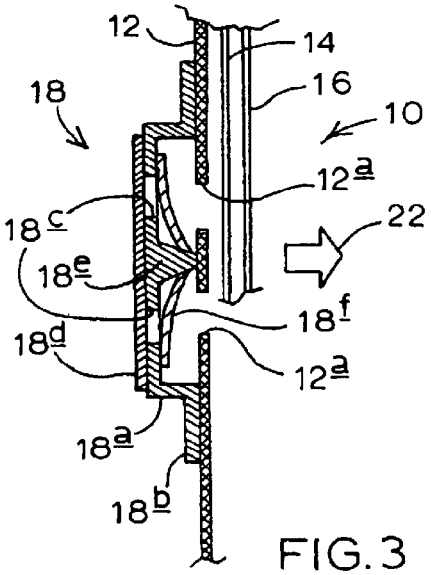
FIG. 3 is a simplified and fragmentary view, on yet a larger scale than that employed in FIG. 2, taken generally along the line 3—3 in FIG. 1, illustrating the incorporated structure of a one-way moisture and gas venting valve which is employed in accordance with the invention in the bag of FIGS. 1 and 2.

Turning attention now to the drawings, and referring first of all to FIGS. 1, 2 and 3, indicated generally at 10 is a storage bag which is designed to contain a bulk dry product, such as powdered milk, and which has incorporated within it a one-way outward gas and moisture valving structure that has been installed in the bag structure in accordance with the present invention. As was mentioned above in the description of the drawings, in FIG. 1, bag 10 is shown in its unfilled and unsealed state, lying flat on an appropriate support surface. In FIG. 2, the bag is shown fragmentarily in a condition after it has been appropriately filled with a dry milk product.

Bag 10 herein takes the form of a three-layer structure, including an inner layer 12, which is an appropriate and conventional (typically plastic) gas and moisture barrier layer, and two outer layers 14, 16, which are made of an appropriate paper, or paper-like, material. In its unfilled and completely flattened form as can been seen in FIG. 1, bag 10 includes an open upper end 10*a*, a closed bottom end 10*b*, and two lateral side edges 10*c*, 10*d*. The thus evident nominal perimeter structure of bag 10, namely, sides or edges 10*a*, 10*b*, 10*c*, 10*d*, generally defines a pair of spaced, broad-area, rectilinear surfaces, such as near surface 10*e* in FIG. 1. Pictured on surface 10*e*, at least partially, in FIG. 1, by dash-dot lines 11, are what can be thought of as fold or bend lines which develop in the bag when it becomes filled with product to have the enlarged condition illustrated generally in FIG. 2.

Appropriately disposed and secured in the structure of bag 10, at the outwardly concealed location generally shown in FIG. 1 by dashed circle line 18, is a generally circular, pancake-shaped, shallow cup-shaped, one-way gas and moisture venting valve which has been incorporated into bag 10 in accordance with the present invention. The specific design of this valve is not part of the present invention. While the exact scale of valve 18 is not precisely illustrated in FIGS. 1 and 2 in the drawings, one should note that this valve is specially positioned in the bag in such a manner that, when the bag is in a pre-filled and flattened condition, such as is illustrated in FIG. 1, the valve lies at a location generally between one lateral side edge of the bag and one of the "fold" lines 11, and very near, or close to, the initially open end 10*a* in the bag. This position for valve 18 is clearly pictured in FIG. 1, and in FIG. 2 the positioning of valve 18 between bag edge 10*c*, and the nearby fold line 11 which is pictured in FIG. 1 on bag expanse 10*e*, is clearly evident in FIG. 2.

It should be mentioned that shown generally at 20 in FIG. 2, but only fragmentarily, is bulk powdered milk which essentially fills the inside of bag 10 as such is illustrated in FIG. 2. As can be seen in FIG. 2, valve 18 is disposed in such a fashion that it is located on the inner side or surface of barrier layer 12, and completely inside outer bag layers 14, 16.

Turning attention now especially to FIG. 3, here valve 18 is shown in detail. This valve includes a very shallow and circular, somewhat pancake and cup-shaped body 18*a* which includes a radially outwardly projecting flange 18*b*. The "cup" in the configuration of body 18*a* is also referred to herein as a well. Flange 18*b* is bonded appropriately to the inner surface of barrier layer 12 in the bag. The central base of the outwardly facing cup which is formed in valve body 18*a* is furnished with an appropriate, generally circular and radiating array of openings 18*c*, and the left sides of these openings in FIG. 3, which are on the side of body 18*a* that faces inwardly into the inside of bag 10, is suitably covered with a gas and moisture pervious filter disk 18*d*. Projecting to the right from the shallow well in body 18*a* is a somewhat conical projection 18*e*, around which fits a very slender, circular, flexible valve closure element 18*f* which is formed of a suitable rubber-like material. Movement of perimeter regions of this closure element to the left and to the right in FIG. 3 relative to openings 18*c* opens and closes these openings in a manner which permits free outward flow of moisture and gas from within the interior of bag 10, but no inward flow. Porosity in bag layers 14, 16 accommodates such a flow, as do also appropriate apertures, such as those shown at 12*a* in FIG. 3, that are formed in barrier layer 12 in the region confronting closure element 18*f*. Outward venting flow of moisture and air through this venting structure is generally indicated by large arrow 22 in FIG. 3. Apertures 12*a* and openings 18*c* cooperate to form a vent passage in bag 10.

Figure 4:
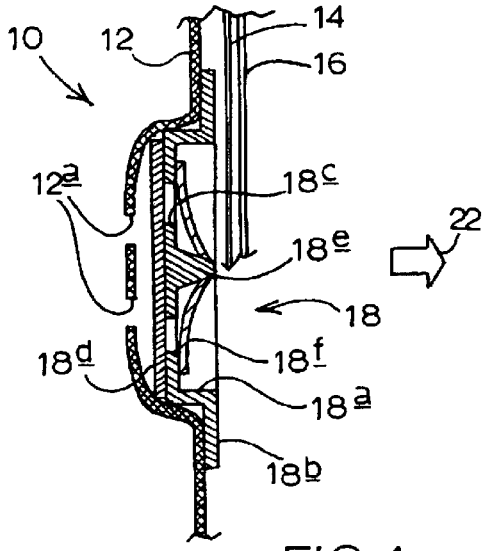
FIG. 4 is a view which is very much like that presented in FIG. 3, except what is here shown is a modified form of the invention wherein a one-way gas and moisture venting value is located, relative to what is shown in FIG. 3, in a somewhat different concealed position with respect to a moisture and gas barrier layer that forms part of the bag of FIGS. 1 and 2.

Switching attention now to FIG. 4 which illustrates a modified form of the invention, what can be seen here is that, instead of valve structure 18 being a located essentially on the inner side of barrier layer 12, it is, rather, here located essentially on the outer side of this barrier layer. It is still, however, concealed within bag layers 14, 16. In all other respects, things are the same in construction, and the same sort of venting of gas and moisture is well accommodated in accordance with the utility of this modification.

With venting valve structure 18 located as illustrated and described so far, it will be clear that, during the filling and sealing process of a bag, and given the fact that the valving structure is located near the open filling end of the bag, gas and moisture which tend to work toward the upper open end of the bag before sealing, end up residing, if at all, predominantly within the bag near the bag's upper sealed end, and thus very near the location of valve 18. This is an important reason for locating valve 18 near what was initially the open end of an unfilled bag.

Figure 5:
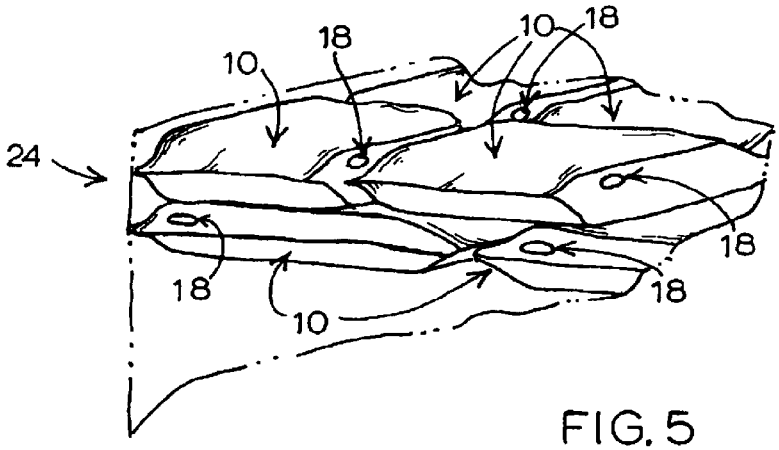
FIG. 5 is a very simplified, fragmentary, isometric view of a palletized stack of plural bags made in accordance with the present invention clearly illustrating how valving structure proposed in accordance with this invention is prevented from becoming blocked and disabled.

When plural bags that have been filled and sealed are stacked in various ways, such as in palletized loads, and here attention is directed to the stack of bags shown at 24 in FIG. 5, one can see that, because of the fact that the valving structure of this invention is initially located in the region mentioned near one lateral edge of a flattened bag, and between this edge and what becomes a fold or bend line, like lines 11, a filled bag causes that deformation which takes place in the sides of the bag to cause the implemented valving structure to angulate so that it is deployed at an angle extending between the two broad faces of the filled bag. Specifically, the valve is deployed in a manner which makes it very unlikely that side-by-side bags in an array of bags, and bags that are stacked one on top of another, will cause a blockage to occur respecting these valves. Concealment of the valve from the outside of the bag minimizes the likelihood of valve damage.

Thus the special positionings which are contemplated for gas and moisture venting structure in accordance with this invention in an otherwise conventional, plural-layer bag structure, uniquely equip a filled bag for reliable unoccluded and on-going as necessary venting of bag-trapped gas and moisture.

As was suggested earlier herein, the exact structure of a one-way valving mechanism is not a part of the present invention, and one should recognize that while a specific valve structure is illustrated herein, and in particular a valving structure which has been found to work very satisfactorily, many other styles and operational designs of one-way valving structure can be employed. What is important is that this valving structure be located at least in one outwardly concealed location in the layer structure of a plural-layer bag, whereby exo-venting of gas and moisture can take place along the side, and near what was initially the open end, of a bag.

Other variations and modifications beyond those that has been shown and suggested herein, will be come apparent to those skilled in the art, and are recognized to come within the scope of the present invention.

I claim:

1. In a one-way, outwardly vented, elongate, plural-layer storage bag having an interior space for receiving and storing bulk material, such as powdered milk, where the bag, in a closed condition, has a pair of spaced, broad facial expanses that are suitably joined to one another adjacent lateral and opposite-end edges, and with the bag being defined, at least partially, by an inner gas and moisture impervious barrier layer, and by an outer layer having porosity which accommodates the outward flow of gas and moisture and which is disposed outwardly of the barrier layer, the structure comprising a one-way gas and moisture flow-accommodating valve operatively disposed in said bag adjacent one of said expanses in a condition fully concealed from the outside of the bag by a region of said outer layer, an openable/closeable valve opening in said valve openable to allow gas and moisture to flow unidirectionally outwardly only relative to the bag's interior space, and at least one vent opening formed in the bag's said barrier layer disposed operatively adjacent and inwardly of said valve opening, and cooperable therewith to promote and permit such unidirectional, outward flow.

2. In a one-way, outwardly vented, elongate, plural-layer storage bag having an interior space for receiving and storing bulk material, such as powdered milk, where the bag, in a closed condition, has a pair of spaced, broad facial expanses that are suitably joined to one another adjacent lateral and opposite-end edges, and with the bag being defined, at least partially, by an inner gas and moisture impervious barrier layer, and by an outer layer having porosity which accommodates the outward flow of gas and moisture and which is disposed outwardly of the barrier layer, the structure comprising a one-way gas and moisture flow-accommodating valve operatively disposed in said bag adjacent one of said expanses in a condition fully concealed from the outside of the bag, an openable/closeable valve opening in said valve openable to allow gas and moisture to flow unidirectionally outwardly only relative to the bag's interior space, and at least one vent opening formed in the bag's said barrier layer, and disposed operatively adjacent and inwardly of said valve opening, said vent opening being cooperable with said valve opening to promote and permit such unidirectional, outward flow.

* * * * *